United States Patent [19]

Yamada et al.

[11] Patent Number: 4,894,637

[45] Date of Patent: Jan. 16, 1990

[54] POSITIVE TEMPERATURE COEFFICIENT THERMISTOR DEVICE

[75] Inventors: Yoshihiro Yamada, Ohmihachiman; Yuichi Takaoka, Shiga; Masahito Mihara; Takashi Shikama, both of Yokaichi, all of Japan

[73] Assignee: Murata Manufacturing Co., Ltd., Japan

[21] Appl. No.: 240,926

[22] Filed: Sep. 6, 1988

[30] Foreign Application Priority Data

Sep. 7, 1987 [JP] Japan ..... 62-223817

[51] Int. Cl.[4] ..... H01C 7/10

[52] U.S. Cl. ..... 338/22 R; 338/25

[58] Field of Search ..... 338/22 R, 22 SD, 25

[56] References Cited

U.S. PATENT DOCUMENTS 4,241,370 12/1980 De Filippis et al. ..... 361/24
4,389,876 6/1983 Szonntagh ..... 338/22 RX
4,414,530 11/1983 Bouffard et al. ..... 338/22 RX

*Primary Examiner*—B. A. Reynolds
*Assistant Examiner*—M. Lateef
*Attorney, Agent, or Firm*—Ostrolenk, Faber, Gerb & Soffen

[57] ABSTRACT

A positive temperature coefficient thermistor device has a case, a positive temperature coefficient thermistor element which is disposed in the case, a pair of first terminals which is disposed in the case to be in contact with corresponding electrodes of the thermistor element, a pair of second terminals which is disposed on the case and is associated with the first terminals, and pin members electrically and mechanically connecting the first terminals with the second terminals through an outer wall of the case.

10 Claims, 3 Drawing Sheets

POSITIVE TEMPERATURE COEFFICIENT THERMISTOR DEVICE

BACKGROUND OF THE INVENTION

1. Field of the invention

The present invention generally relates to a device including a thermistor element having a characteristic of a positive temperature coefficient of electrical resistivity (referred, hereinafter, to as PTC), where the PTC thermistor element is enclosed in a case. In particularly, the present invention relates to the PTC thermistor device for use in starting an single phase, asynchronous electrical motor in a refrigerator compressor and the like.

2. Description of the related art

The thermistor element of the PTC thermistor device for use in starting an electrical motor is connected to an electrical power source in series with an auxiliary start winding for starting the motor. In motor starting, the temperature of the thermistor element itself of the PTC thermistor device is low so that it remains in a low resistance condition. Consequently, in motor starting, the thermistor element permits a high initial current to be supplied into the auxiliary start winding for starting the motor, so that the motor can start. Subsequently, the thermistor element is heated up and stabilized in a high resistance condition due to the self-heating thereof, which is generated by the current supplied during the running of the motor so that the supply of current to the auxiliary start winding is automatically stopped.

Conventionally, this type of PTC thermistor device is removably coupled with the projected hermetic terminals which are provided for the motor. There is shown one example of such conventional device which is disclosed in U.S. Pat. No. 4,241,370. FIGS. 4 and 5 show, respectively, the above-described example. As it is apparent from FIGS. 4 and 5, this type of device includes a case $\mathbf{1}_0$ having a pair of openings $\mathbf{2}_0$, $\mathbf{3}_0$ in which the "plug-in" type terminals $\mathbf{4}_0$, $\mathbf{5}_0$ are, respectively, provided. The corresponding hermetic terminals A and B are, respectively, inserted in the "plug-in" terminals $\mathbf{4}_o$, $\mathbf{5}_o$. The "plug-in" type terminals $\mathbf{4}_0$, $\mathbf{5}_0$ are, respectively, connected to the corresponding contact terminals $\mathbf{7}_0$, $\mathbf{8}_0$ which are accommodated in the case $\mathbf{1}_0$ to be in contact with the respective electrodes of a PTC thermistor element $\mathbf{6}_0$. It is to be noted that a reference symbol C in FIG. 4 indicates a common terminal to be connected with a power source. This common terminal C connects a terminal of a main winding (not shown) with the terminal A or B of the auxiliary start winding for starting the motor. As described above, the conventional PTC thermistor device has the openings which are through an outer wall of the case $\mathbf{1}_0$, therein two hermetic terminals A and B are, respectively, connected with the corresponding "plug-in" terminals $\mathbf{4}_0$, $\mathbf{5}_0$. Therefore, the humid air and/or oxidizing gas are able to come easily into the inside of the case $\mathbf{1}_0$ through the openings. This causes the thermistor element $\mathbf{6}_0$ to be degraded. Furthermore, the respective contact terminals $\mathbf{7}_0$, $\mathbf{8}_0$ are oxidized by the humid air which intrudes into the inside of the case $\mathbf{1}_0$, thus resulting in that electrically imperfect contact could be caused between the contact terminals $\mathbf{7}_0$, $\mathbf{8}_0$ and the electrodes of the thermistor element $\mathbf{6}_0$. In the conventional PTC thermistor device, there are such disadvantages as described above.

In addition to the above, in the case where the hermetic terminals A and B are inserted from the improper direction to the respective "plug-in" terminals $\mathbf{4}_0$, $\mathbf{5}_0$, there happens that the above-mentioned two members are not properly connected with each other. In this case, sparking at a connecting portion of two members may occurs. However, it is difficult to find out whether or not a connected condition of both terminals $\mathbf{4}_0$, A; $\mathbf{5}_0$, B is proper since the connecting portion of the two is covered by the outer wall of the case $\mathbf{1}_0$. So, even if it is improper, an apparatus attaching the PTC thermistor device can be delivered from a factory. Accordingly, the possibility of the above-mentioned situation, i.e., the imperfect contact, can be thinkable as well in the conventional PTC thermistor device because of its structure.

SUMMARY OF THE INVENTION

Accordingly, a first object of the present invention is to provide an improved PTC thermistor device which is capable of preventing the humid air and/or the oxidizing gas from coming into the inside of the device so that degradation of the thermistor element as well as oxidation of the contact terminals can be prevented, due to the intrusion of the above-mentioned air or gas into the inside of the device.

It is a second object of the present invention to provide a desirable PTC thermistor device having improvement of reliability and durability of the device by accomplishment of the first object.

In accomplishing these and other objects, according to one preferred embodiment of the present invention, there is provided an improved positive temperature coefficient thermistor device for use in starting a motor, which comprise a case, a thermistor element of positive temperature coefficient of resistivity disposed in the case, a pair of first terminals disposed in the case to be in contact with corresponding electrodes of the thermistor element, a pair of second terminals to be connected with the first terminals, and connecting means for electrically connecting the first terminals with the second terminals respectively, wherein the improvement is that the second terminals are mounted on an outer surface of the case and connecting means comprises a pin member which penetrates the case to mechanically connect the first terminals with the second terminals.

In the PTC thermistor device having the above-mentioned structure, the second terminals are electrically connected with the respective electrodes of the thermistor element through the corresponding pin members and first terminals. Accordingly, it is enabled that the case is of a totally enclosed casing, so that there is no penetration of the air and/or gas into the case inside from the case outside.

Furthermore, electrical connection between this device and a motor can be fulfilled through the second terminals of this device. That is, a condition of the connection between the second terminals and terminals of the motor side can be easily confirmed visually since the second terminals are located on the case outside.

As described above, the totally enclosed casing is applicable to the case of this device, so that accommodated members in the case such as the thermistor element and the first terminals are protected against the humid air and/or oxidizing gas. Therefore, degradation of the thermistor element and oxidation of the first terminals can be hardly caused by influence of atmosphere surrounding the device. this is, in other words, to mean improvement of a device's life. Further, since the connecting condition of both terminals can be easily confirmed, imperfect contact between the second terminals of the device and the terminals of the motor can be effectively avoided. This means to prevent an outbreak of an accident which is caused in future by the above-mentioned imperfect contact, thus resulting in that reliability of the device is improved, accordingly.

BRIEF DESCRIPTION OF THE DRAWINGS

These and other objects and features of the present invention will become apparent from the following description taken in conjunction with one preferred embodiment thereof with reference to the accompanying drawings, in which.

DETAILED DESCRIPTION OF THE INVENTION

Figure 1:
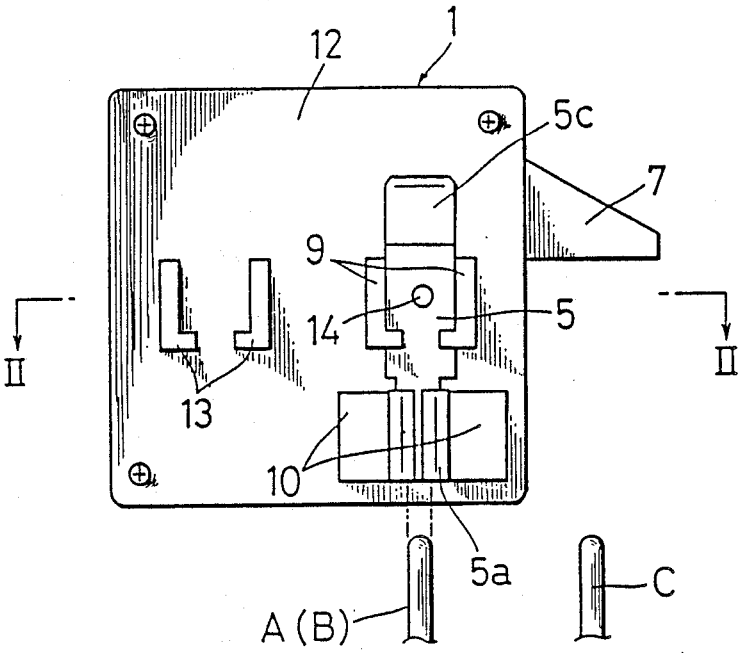
FIG. 1 is a side elevation view of a positive temperature coefficient thermistor device according to one preferred embodiment of the present invention.

Before the description of the present invention proceeds, it is to be noted that like parts are designated by like reference numerals and symbols throughout the several views of the accompanying drawings.

Figure 2:
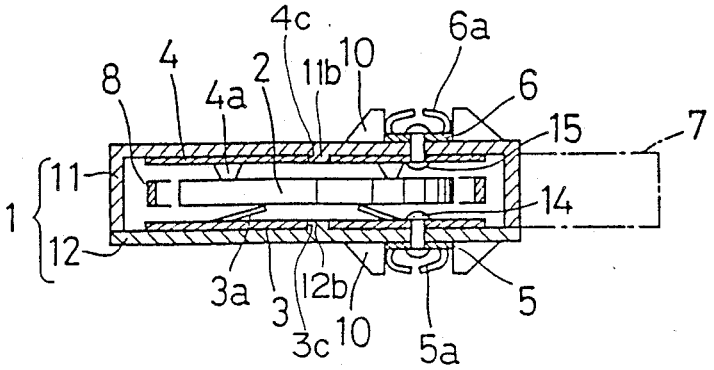
FIG. 2 is a transverse cross-section view taken along line II—II of FIG. 1.

Referring now to drawings of FIGS. 1 and 2, particularly to FIG. 2 thereof, a positive temperature coefficient thermistor device, for use in starting a motor, according to this embodiment of the present invention includes a case 1 inside of which is disposed a thermistor element 2 of a material with a positive temperature coefficient (PTC) of a type well known to the skilled in the art. This device is a type of that the thermistor element 2 is totally enclosed by the case 1. As shown in FIGS. 1 and 2, the device comprises the case 1, the disk-formed PTC thermistor element 2, a pair of contact terminals 3, 4, as a first terminal of the device, of plane metal plates which are circularly formed and which are brought into contact with the respective electrodes of the thermistor element 2, and a pair of "plug-in" type terminals 5, 6, as a second terminal of the device, which are connected with hermetic terminals A and B provided on the side of a motor (not shown).

The above-mentioned case 1 is so formed that a width of the case becomes slightly shorter than a length between the above-mentioned two hermetic terminals A and B which are removably jointed to this device. The case 1 comprises a casing 11 having an opening on one side and a lid 12 by which the opening of the casing 11 is covered tightly. In the casing 11, a projecting member 7 is fitted therearound. The purpose of this member 7 is for pressing down another hermetic terminal C which is one of three hermetic terminals A, B and C and is not jointed to the device. Furthermore, projections 11*b*, 12*b* are arranged around central portions of a bottom surface of the casing 11 and a rear surface of the lid 12, respectively. The respective projections 11*b*, 12*b* have a function of positioning a pair of the contact terminals 3, 4 as described later on.

The above-mentioned thermistor element 2 and a pair of the contact terminals 3, 4 are disposed in the case 1 which is closed up tightly. Besides, an annularly formed insulating holder 8 of an inorganic material is disposed around the thermistor element 2 so as to position the thermistor element 2 in the case 1.

Both of the contact terminals 3, 4 described above are, respectively, of a round metal plate so as to correspond to a shape of the thermistor element 2. One 3 of the contact terminal 3, 4 has a plurality of tongue-shaped contact portions 3*a*, 3*a*, . . . which have a characteristic of a spring function. Each one 3*a* of the tongue-shaped contact portions protrudes toward the thermistor element 2 and comes in contact with one of the electrodes of the thermistor element 2. The other 4 has a plurality of contacting projections 4*a*, 4*a*, . . . to be in contact with the other of the electrodes on its surface facing the thermistor element 2. Furthermore, around a central portion of each contact terminal 3, 4, there is provided a mating hole 3*c*; 4*c* for easily positioning each contact terminal 3, 4 in the case 1 when fitting the respective contact terminals 3, 4 onto the respective case members, i.e., the casing 11 and the lid 12. It is so designed that these mating holes 3*c*, 4*c* are engaged by the respective projections 11*b*, 12*b* correspondingly arranged on the respective case members 11, 12.

Both of the "plug-in" type terminals 5, 6 have a female type jointing portion 5*a*; 6*a* by which the hermetic terminals A and B are held elastically therein, respectively. One 5 of the terminals 5, 6 has a male type connecting terminal 5*c*, formed as one body thereof, being capable of connecting with a connector (not shown) on the power source side. The above-mentioned two "plug-in" type terminals 5, 6 are arranged at a certain position on the outer surface of the case, where these terminals 5, 6 confront the contact terminals 3, 4 disposed in the case 1 through the case wall. When each terminal 5; 6 is fitted at its position on the outer surface, it is so designed that an interval of two terminals 5, 6 accords with that of two hermetic terminals A and B to be connected with this device. In this embodiment, one 5 of the above-mentioned terminals 5, 6 is arranged on the front surface of the lid 12, and the other 6 is arranged on the rear surface of the casing 11. On the outer surface of the case 1 (i.e., the front surface of the lid 12 and the rear surface of the casing 11) where the respective "plug-in" type terminals 5, 6 are arranged, there are formed a protruding portion 9 for positioning each central part of each terminal 5; 6 and a protruding portion 10 for positioning the above-mentioned connecting portion 5*a*; 6*a* of each terminal 5; 6, respectively. It is to be noted that each shape of the respective protruding portions arranged on the rear face of the casing 11 is same as that of the respective protruding portions 9, 10 arranged on the lid 12. Further, a reference numeral 13 designates a spare protruding portion for fitting one more terminal.

The respective "plug-in" type terminals 5, 6 and contact terminals 3, 4 being corresponding to these terminals 5, 6 are, respectively, connected with each other by pin members 14, 15, such as a rivet or a machine screw, which are of a material having electric conductivity, at least of which these surface are covered with that material. These pin members 14, 15 are members for penetrating the outer wall of the case 1. That is, one 14 of pin members 14, 15 penetrates the lid 12, thereby one 3 of the contact terminals 3, 4 and one 5 of the "plug-in" terminals 5, 6 are mechanically and electrically connected with each other through the lid wall as well as, at the same time, the "plug-in" terminal 5 is fixed at its position on the front surface of the lid 12.

The other 15 penetrates a bottom wall of the casing 11, thereby other contact terminal 4 and "plug-in" terminal 6 are similarly connected with each other through the bottom wall and, at the same time, the "plug-in" terminals 6 is fixed at its position on the rear surface of the casing 11 as well.

Figure 3:
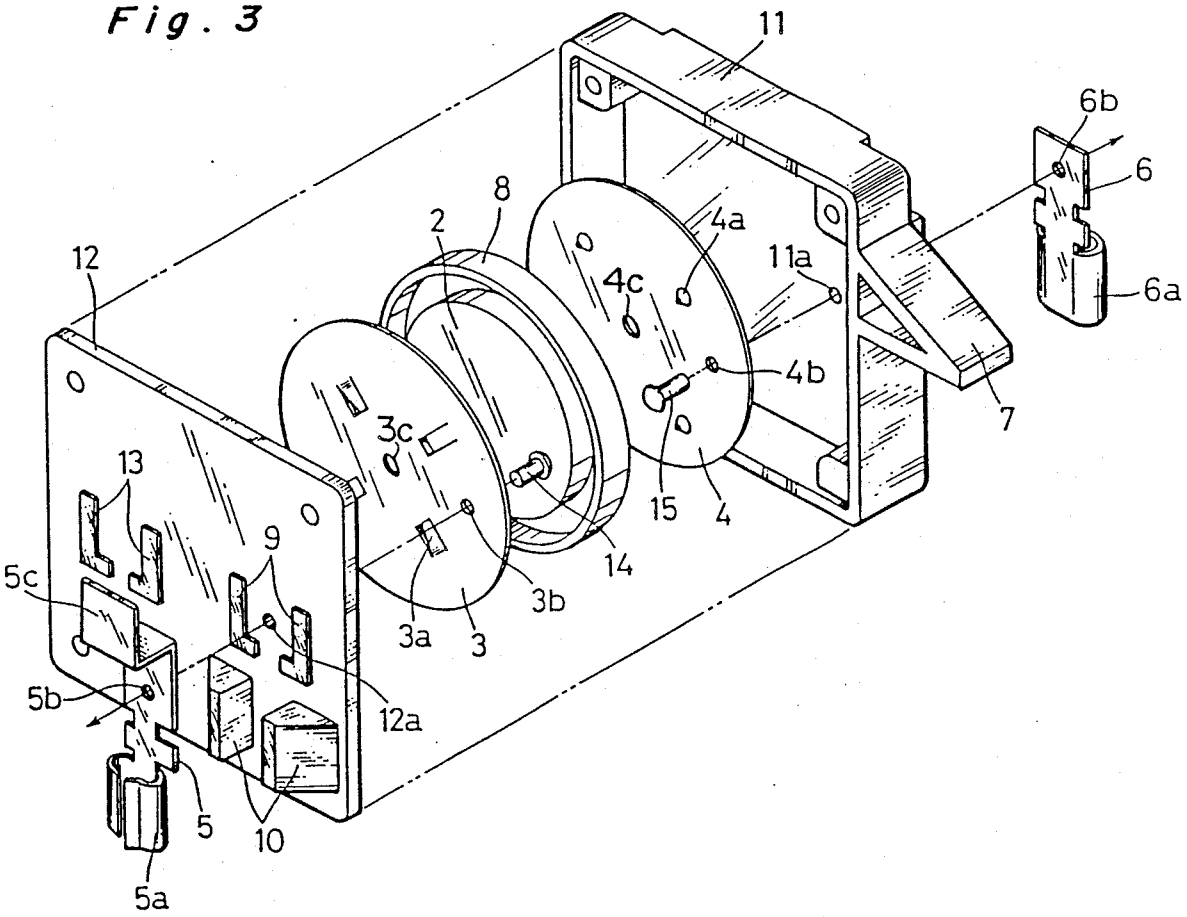
FIG. 3 is a perspective illustration of the PTC thermistor device.
Figure 4:
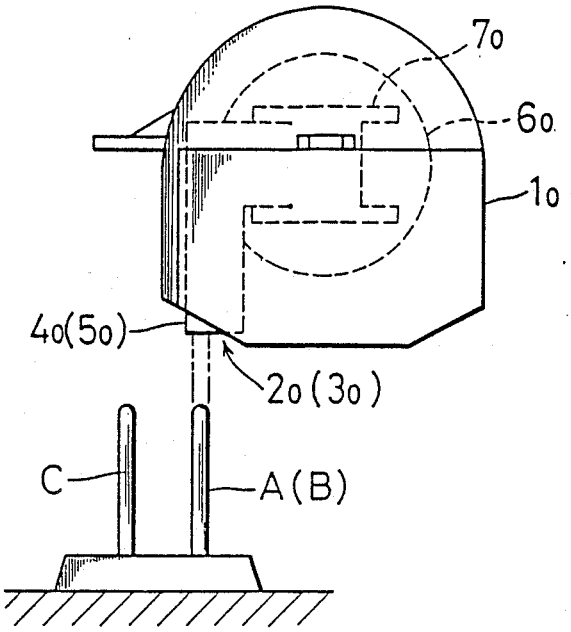
Fig. 4 PRIOR ART
FIG. 4 and FIG. 5 are respectively a side elevation view and bottom view of a conventional type PTC thermistor device, as previously described.
Figure 5:
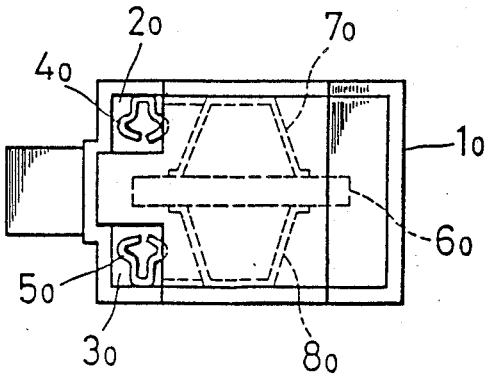
Fig. 5 PRIOR ART

In FIG. 3, there is shown an arrangement of the PTC thermistor device of this embodiment. In the drawing, reference numerals 3*b*, 4*b*, respectively, designate throughholes formed at the respective contact terminals 3, 4 so as to insert the pin members 14, 15 therein, and reference numerals 11*a*, 12*a*, respectively, designate through-holes formed at the casing 11 and the lid 12, in which the respective pin members 14, 15 penetrate, and reference numerals 5*b*, 6*b*, respectively, designate through-holes formed at the respective "plug-in" type terminals 5, 6 so as to insert the respective pin members 14, 15 therein.

The PTC thermistor device is arranged in such a way that the respective "plug-in" type terminals 5, 6 are coupled to the corresponding hermetic terminals A, B provided for the motor, in the case where these "plug-in" terminals 5, 6 may be inserted into the corresponding hermetic terminals A and B after theses position adjustment to the hermetic terminals A and B, so as to couple these "plug-in" terminals 5, 6 to the hermetic terminals A, B. Thus, the respective hermetic terminals A, B are electrically connected with the thermistor element 2 since the respective "plug-in" terminals 5, 6 are electrically connected with the electrodes of the thermistor element thought the corresponding contact terminals 3, 4 and pin members 14, 15.

As it is apparent from the above-mentioned description, the PTC thermistor element 2 and the contact terminals 3, 4 are not influenced by the outer atmosphere surrounding the device since the case 1 accommodating these members 2, 3, 4 are closed up tightly. Moreover, the "plug-in" terminals 5, 6 are arranged outside the case, so that the connecting condition how these terminals 5, 6 are connected with the respective hermetic terminals A and B can be visually found out. Accordingly, the members accommodated in the case 1, i.e., the thermistor element 2 and two contact terminals 3, 4, are kept in desirably good condition, in other words, kept in less degradation. In addition, it is possible to prevent troubles or accidents caused by the electrically imperfect connection being at the connecting terminals between the motor and the device from happening since it is easily possible to correct the electrically imperfect connection therebetween, if any.

Although the present invention has been fully described by way of example with reference to the accompanying drawings, it is to be noted, here, that various change and modifications will be apparent to those skilled in the art. For example, the PTC thermistor element 2, a pair of the contact terminals 3, 4 and the insulating holder 8 are, respectively, formed circularly or annularly in this embodiment. However, it is permitted that these members are formed rectangularly or in the form of any other shape, as the occasion demands. Furthermore, regarding a shape of the contact terminals 3, 4, it is permitted that both contact terminals have a plurality of the tongue-shaped contact portions same as the above description, respectively or have a plurality of the projections as the contact portions to the electrodes, respectively. Therefore, unless otherwise such changes and modifications depart from the scope of the present invention, they should be construed as included therein.

What is claimed is:

1. A positive temperature coefficient thermistor device comprising:

a substantially thermally and electrically insulating case, a positive temperature coefficient thermistor element disposed in said case, a pair of first terminals disposed in said case and having electrodes extending from said first terminals and in contact with corresponding respective portions of said thermistor element, a pair of second terminals respectively connected with said first terminals, and connecting means for electrically connecting said first terminals with said second terminals, wherein said second terminals are mounted on an outer surface of said case opposite said respective first terminals and said connecting means comprises a pair of pin members which penetrate said case to mechanically and electrically connect the first terminals with the second terminals.

2. A positive temperature coefficient thermistor device as claimed in claim 1, further comprising holder means disposed in said case so as to surround said thermistor element, to restrict said thermistor element at its predetermined position in said case.

3. A positive temperature coefficient thermistor device as claimed in claim 1, wherein said case has a pair of respective support faces for supporting said first terminals, each support face having a plane surface for supporting one of said first terminals, while each one of said first terminals is thin and disk-shaped and has a through-hole engaged by a projection which is formed on the plane surface of said support face.

4. A positive temperature coefficient thermistor device as claimed in claim 3, wherein said electrodes of a first one of said first terminals are a plurality of springy tongue members which respectively protrude toward and contact said thermistor element.

5. A positive temperature coefficient thermistor device as claimed in claim 1, wherein said case has positioning means which are arranged at predetermined positions on said outer surface thereof to locate said second terminals at these predetermined positions.

6. A positive temperature coefficient thermistor device as claimed in claim 4, wherein said electrodes of the second one of said first terminals are protruding projections, substantially less springy than said springy tongue members of said first one of said first terminals, which protrude toward and contact said thermistor element.

7. A positive temperature coefficient thermistor device as claimed in claim 1, wherein said device comprises sealing means for substantially sealing ambient gases, liquids, and vapors away from said positive temperature coefficient thermistor element, and away from said first terminals disposed in said case.

8. A positive temperature coefficient thermistor device as claimed in claim 7, wherein said sealing means includes a closely fitting seal formed between said pin members and said case at the location where said pin members penetrate said case.

9. A positive temperature coefficient thermistor device as claimed in claim 8, wherein said pin members are rivets.

10. A positive temperature coefficient thermistor device as claimed in claim 8, wherein said pin members are screws.

* * * * *